US005244179A

United States Patent [19]

Wilson

[11] Patent Number: 5,244,179

[45] Date of Patent: Sep. 14, 1993

[54] DIAPHRAGM STOP FOR SENSOR-OPERATED, BATTERY-POWERED FLUSH VALVE

[75] Inventor: John R. Wilson, Naperville, Ill.

[73] Assignee: Sloan Valve Company, Franklin Park, Ill.

[21] Appl. No.: 932,954

[22] Filed: Aug. 21, 1992

[51] Int. Cl.[5] ..... F16K 31/126

[52] U.S. Cl. ..... 251/30.03; 251/30.05; 251/42; 251/285

[58] Field of Search ..... 251/30.01, 30.02, 30.03, 251/30.04, 30.05, 60, 285, 129.15, 45, 46, 42, 284

[56] References Cited

U.S. PATENT DOCUMENTS

| | | | |
|---|---|---|---|
| 3,166,293 | 1/1965 | Specht | 251/285 |
| 4,309,781 | 1/1982 | Lissau | 4/304 |
| 4,671,485 | 6/1987 | Saarem | 251/60 X |
| 4,793,588 | 12/1988 | Laverty, Jr. | 251/30.03 |

*Primary Examiner*—Martin P. Schwadron
*Assistant Examiner*—Kevin L. Lee
*Attorney, Agent, or Firm*—Kinzer, Plyer, Dorn, McEachran & Jambor

[57] ABSTRACT

A sensor-activated, battery-powered toilet room flush valve has a body with an inlet and an outlet. There is a valve seat in the body and a diaphragm which closes upon the seat to control flow between the inlet and the outlet. A cover mounted on the body defines a pressure chamber with the diaphragm and there are a sensor, solenoid and battery mounted on the cover and connected for operation of the flush valve. There is a passage in the cover connecting the pressure chamber and the outlet. Operation of the solenoid opens the passage to relieve pressure in the chamber to the outlet whereby the diaphragm moves off its seat to open communication between the inlet and outlet. A stop is positioned within the chamber and attached to the diaphragm to limit its movement toward the cover, which in turn controls the volume of water passing through the flush valve prior to closure of the diaphragm upon its valve seat. The stop is adjustable from the outlet side of the valve.

19 Claims, 2 Drawing Sheets

DIAPHRAGM STOP FOR SENSOR-OPERATED, BATTERY-POWERED FLUSH VALVE

THE FIELD OF THE INVENTION

Infrared operated flush valves for use on urinals and water closets in public washrooms are known in the art and it is also known to use battery power to operate the flush valve. See U.S. Pat. No. 4,309,781 and 4,793,588. In order to conserve battery power it is desired to use latching solenoids. The present invention is specifically concerned with such a flush valve of the type manufactured and sold by Sloan Valve Company, assignee of the present application, under the trademark ROYAL. The system uses the OPTIMA infrared sensor for activation of the flush valve. The present invention is more particularly concerned with a means for controlling movement of the diaphragm in a ROYAL-type valve so as to tightly control the volume of water passing through the flush valve. A stop is attached to the diaphragm which limits movement of the diaphragm toward the cover mounting the electrical components of the flush valve. The stroke of the diaphragm controls the volume of water passing through the flush valve and the stop determines the stroke. The stop is adjustable from the outlet side of the flush valve so that maintenance personnel may do so without disassembling the flush valve. The stop is also hidden so that it is inaccessible to vandals. The diaphragm includes a conventional bypass orifice which has a cross sectional area smaller than that of any portion of the passage which vents the chamber between the diaphragm and the cover so that any sediment which reaches the chamber between the diaphragm and the cover will always be vented through the outlet.

SUMMARY OF THE INVENTION

The present invention relates to diaphragm operated toilet room flush valves and in particular to improvements of such valves to closely control the volume of water for each flushing operation.

A primary purpose of the invention is a flush valve construction as described including means for controlling the stroke of the diaphragm which in turn controls the volume of water passing through the flush valve.

Another purpose is a flush valve as described including means for adjusting the stroke from the outlet side of the flush valve.

Another purpose is a flush valve in which the stroke adjustment is hidden from view to prevent vandalism.

Another purpose is a flush valve as described in which the electrical components for operating the flush valve and the adjustable stroke diaphragm may be retrofitted onto an existing flush valve structure without removing the flush valve from its installation.

Another purpose is a flush valve construction as described utilizing a bypass orifice in the diaphragm and a solenoid controlled passage between the pressure chamber and the outlet with the bypass orifice being smaller in cross sectional area than any portion of the passage controlled by the solenoid to insure that any foreign matter will always be expelled from the pressure chamber and will not clog the passages that control operation of the flush valve.

Another purpose is a simply constructed reliably operable retrofit assembly for modifying a manual flush valve to sensor controlled operation.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

The assignee of the present application, Sloan Valve Company, of Franklin Park, Ill., sells several types of flush valves for use in commercial washrooms to operate both urinals and water closets. Such valves may be manually operated or they may be operated through the use of an infrared sensor, the latter being sold by Sloan Valve Company under the trademark OPTIMA.

The present application is specifically concerned with a valve similar to the ROYAL flush valve, but which is battery powered and operated through the use of an infrared sensor. The construction shown and described may be sold as original equipment, or it may be sold as a conversion kit in which an existing valve of the ROYAL type may have its top cover removed and the cover and associated parts described herein placed on the existing valve structure which then provides a sensor controlled, battery powered flush valve which has no requirement for manual operation. The structure described has application in various other types of flush valves and should not be limited to the valves of Sloan Valve Company or its ROYAL flush valve.

The present invention is specifically concerned with a stop to limit the stroke of the diaphragm to control the volume of flow through the flush valve and the manner in which the position of the stop may be adjusted to vary the stroke. The stroke is adjusted from the outlet side of the flush valve which permits adjustment without turning off water to the flush valve and without purging the valve. Further, the adjustment is hidden to prevent misuse by vandals. The invention is also particularly concerned with the various openings which form the bypass passages to vent the pressure chamber to permit movement of the diaphragm for flush valve operation. The openings are sized so that any particle which reaches the pressure chamber must be vented through the relief passages.

Figure 1:
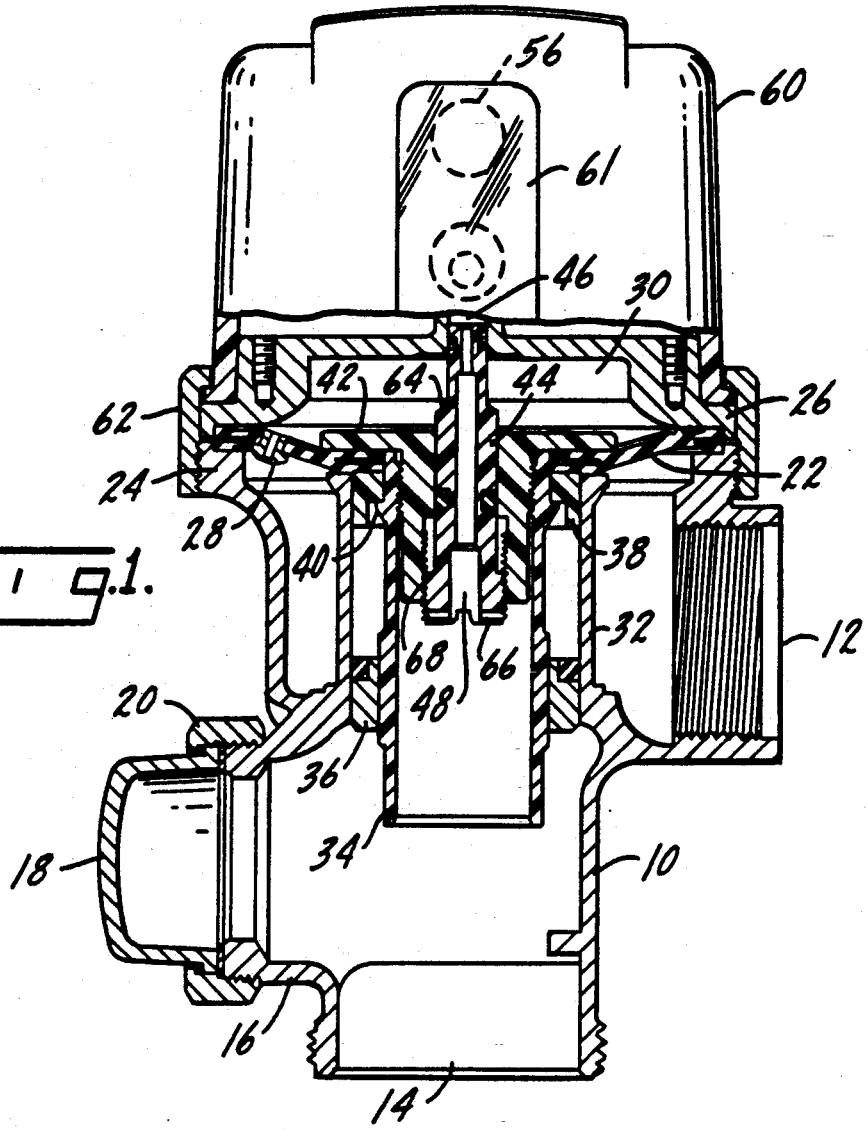
FIG. 1 is a section through the flush valve of the present invention as viewed from the front.
Figure 2:
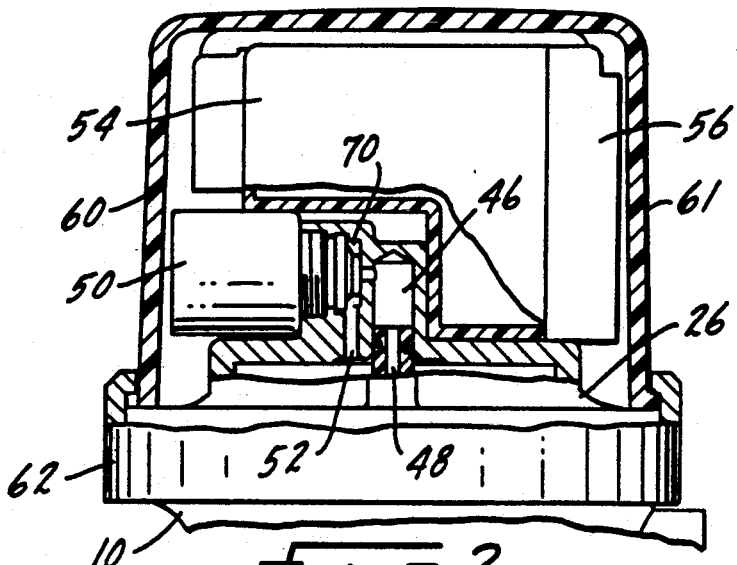
FIG. 2 is a section through the top portion of the valve taken at 90 degrees to FIG. 1.
Figure 3:
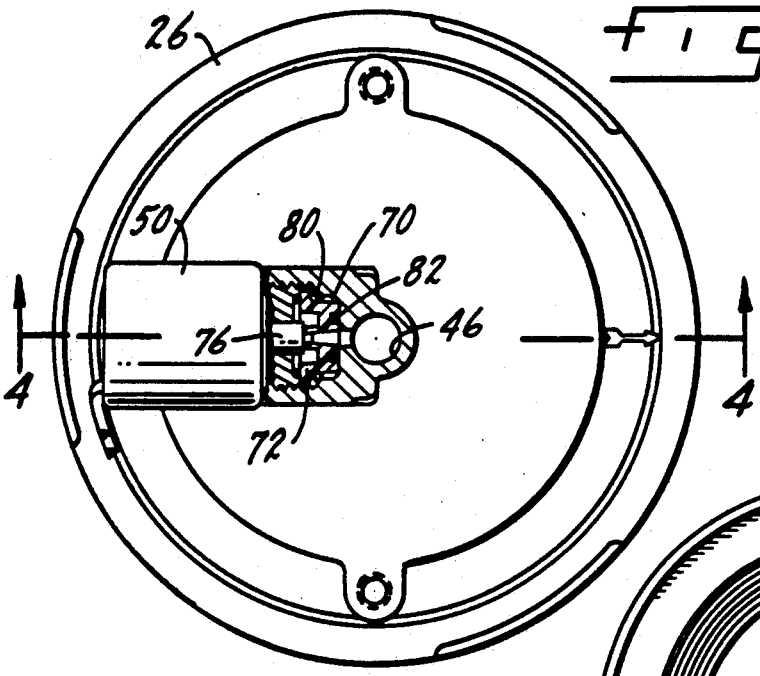
FIG. 3 is a top view of the inner cover with parts in section, with the solenoid inoperative.
Figure 5:
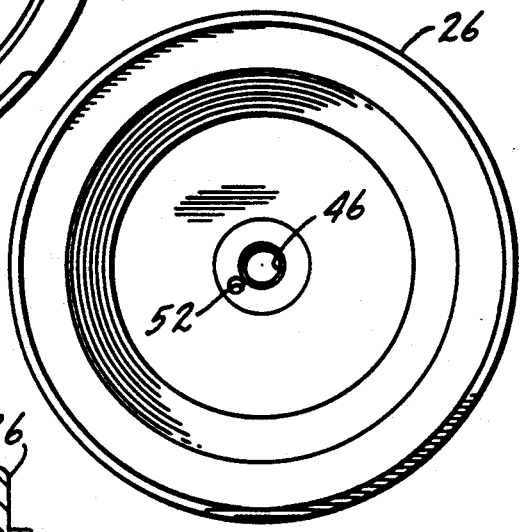
FIG. 5 is a bottom view of the inner cover.
Figure 4:
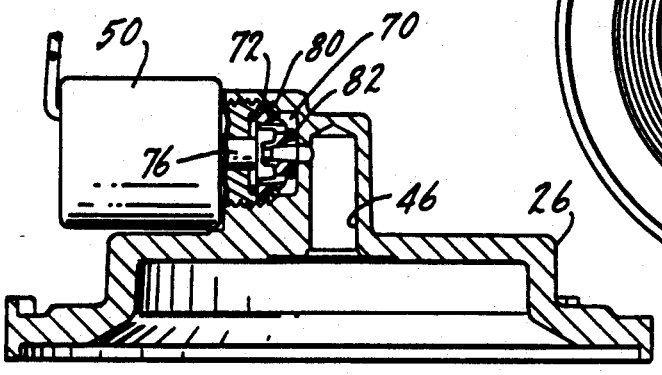
FIG. 4 is a section taken on line 4—4 of FIG. 3, with the solenoid operative.
Figure 6:
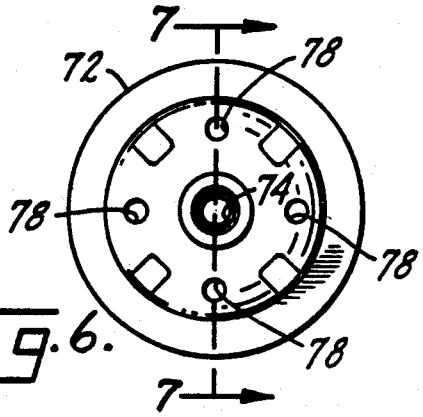
FIG. 6 is an end view of the seat member.
Figure 7:
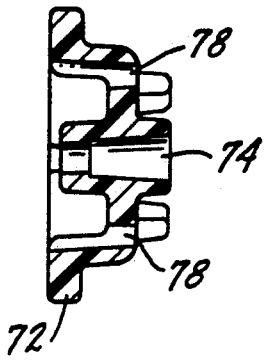
FIG. 7 is a section taken on line 7—7 of FIG. 6.

In FIG. 1 a flush valve body is indicated at 10 and may have an inlet opening 12, and a bottom directed outlet opening 14. There is a boss 16 at the left side of outlet 14 and normally this is the location of the manual handle. However, in the present instance, a cap 18 may close this opening and may be held in position by a lock ring 20.

The valve shown is of the ROYAL type and thus uses a diaphragm to control flow between the inlet and outlet. The diaphragm is indicated at 22 and is held at its periphery between a portion 24 of body 10 and the underside of an inner cover 26. The diaphragm has a bypass orifice 28 which is in communication with valve inlet 12 and which is used to fill the chamber 30 beneath inner cover 26 and above diaphragm 22.

The valve body includes a throat 32 within which is positioned a guide 34 centered in the throat by a flow control ring 36. A refill ring 38 is positioned at the upper end of guide 34 and is mounted on an outwardly extending shelf 40 on the guide. A piston disc 42 is threaded to the inside of guide 34 and is used to attach the assembly of the guide and refill ring to diaphragm 22. Thus, these elements all move in unison as the diaphragm moves between open and closed positions of the valve. The diaphragm subassembly is completed by a piston screw 44 which is threaded to the inside of piston disc 42 and extends upwardly into a bore 46 in inner cover 26. Piston screw 44 may have a passage 48 which is in communication with the valve outlet 14 for relief of chamber 30 when the valve is operated.

Mounted on top of inner cover 26 is a solenoid 50, the operation of which controls water flow from chamber 30 through a passage 52 in inner cover 26 and into bore 46 in the inner cover. Thus, the solenoid controls the venting of chamber 30 through passages 52, 48 and bore 46 to the outlet 14 of the flush valve.

Also mounted on top of upper cover 26 are batteries in housing 54 which power the solenoid and an infrared sensor in housing 56 which has a transmitter and receiver. The transmitter will emit infrared radiation and if there is an object nearby, such radiation will be reflected back to the receiver and the received radiation at the receiver will cause the batteries to power solenoid 50 to open the described passages to permit operation of the flush valve in a well known manner. The use of infrared sensors in this environment is old in the art and will not be described in detail. Reference is made to the above-mentioned U.S. patents.

There is an outer cover or dome 60 which encloses the electrical operating components of the flush valve. This dome is held onto the flush valve body and to inner cover 26 through the use of a locking ring 62. The material of dome 60 is important. Preferably, it is formed of a plastic which is highly resistant to the chemicals which may be found in washrooms and which may be used for cleaning purposes in washrooms. The material must also be highly impact resistant so as to resist attempts at vandalism. It has been found that polysulfone is a highly desirable plastic material for this purpose. The plastic dome 60 will be colored with a tint which will not impede or interfere with the transmission of infrared signals from the sensor, but will tend to mask or obscure the interior elements in the flush valve electrical control. It is preferred that a pigment be added to the polysulfone so that approximately 70 percent of visible light at all wave lengths will pass through the dome and approximately 30 percent will be impeded. A pigment made by Amoco bearing spec number BK1615 provides a not-quite-black, deep lavender dome which obscures the interior components, but yet permits transmission of a very substantial portion of light at all wave lengths.

In some applications, outer cover 60 may have a defined window 61 which is in alignment with sensor 56. This window will be made of the same material as other portions of the dome, but may be more highly polished in contrast with the somewhat matte finish of the remaining portions of the dome. An advantage of the window is it orients the dome relative to the sensor.

Piston screw 44 has a stop 64 which limits the stroke of the diaphragm assembly toward the underside of inner cover 26. The diaphragm assembly, which includes diaphragm 22, piston disc 42, piston screw 44, and guide 34 moves as a unit toward the inner cover when pressure in chamber 30 is relieved.

The piston screw 44 is adjustable to vary the position of stop 64 relative to the underside of the cover. A tool receiving slot 66 is at the bottom of piston screw 44 so that rotation of the piston screw in its threaded engagement 68 with the piston disc will change the position of the screw relative to the piston disc and the inner cover and thus move the stop to thereby adjust the stroke. It should be understood that the shoulder 64 is only one form of stop that may be utilized and the invention should not be limited thereto.

It is important in today's commercial market to closely control the volume of water that passes through the flush valve each time it is operated. Various government bodies have passed regulations defining what water flow is permitted through a flush valve in commercial washrooms. Often these regulations require that the flow be controlled to $\pm 0.1$ gal. A movement of the stop 64 through a distance as small as 0.003 in. can change the flow through the flush valve by 0.1 gal. The adjustment of the stop is thus critical.

It is important to note the location of the adjustment. The upper side of the diaphragm is pressurized under normal use, whereas, the lower side is only pressurized when the flush valve is open. Thus, the flush valve can be disassembled from the vacuum breaker side without making any change in the connections to the inlet side of the flush valve. This permits a maintenance person to reach the piston screw and its screwdriver adjustment slot 66. Not only can the flush valve be adjusted from the nonpressurized side, but also the adjustment is hidden from view essentially making the adjustment vandalproof. Further, the fact that the adjustment can be made from the outlet side permits adjustments at the factory during testing and to be made prior to shipment of the valve without purging the valve of water in the pressure chamber before making the adjustment.

There is a solenoid chamber 70 formed within inner cover 26 which is in communication with bore 46 in the cove and passage 52 in the cover. Water is vented from pressure chamber 30 through passage 52, solenoid chamber 70, bore 46, and then passage 48 in the piston screw. Positioned within chamber 70 is a seat member 72 having an axial passage 74 which faces solenoid plunger 76. The plunger 76 in its unoperated position closes passage 74. Seat 72 also has a plurality, for example four, passages 78 which connect the opposite sides of the seat. Water flowing in through inner cover passage 52 will flow into the area at the right side of seat 72. Such water will flow into the left side area of seat 72 through passages 78. When the plunger is retracted such water can then flow through passage 74 into bore 46 to vent chamber 30. 0-rings 80 and 82 are positioned to seal the seat member within chamber 70 and prevent any leakage through this chamber into bore 46. It is important to note that the seals 80 and 82 are not under compression and the seat member precisely controls the stroke of the solenoid plunger. It is desired to keep this stroke short to minimize solenoid power requirements.

In operation of the flush valve, the diaphragm will be held on its seat by the pressure in chamber 30. When solenoid 50 is operated, due to the sensing of an object by the infrared sensor system, the solenoid plunger 76 will move away from seat 72. Water in chamber 30 will flow through passage 52, passages 78 into chamber 70, then through passage 74, bore 46, and out piston screw passage 48 to the outlet. The immediate result of the relief of pressure in chamber 30 is the movement of the diaphragm away from its seat opening direct communication between the flush valve inlet and outlet. As soon as the diaphragm moves away from its seat, chamber 30 will begin to refill through bypass orifice 28. The time in which it takes for the chamber to refill is determined by the stroke of the diaphragm assembly as controlled by stop 64. Thus, the stop controls the time it takes to refill chamber 30, which in turn determines the time during which the flush valve is open for water to pass. The stroke of the diaphragm assembly controls the duration of the flush and thus the volume of water passing through the flush valve.

In order to prevent any sediment from clogging any of the described orifices or passages, it is important that bypass orifice 28 have a smaller cross section than that of seat passages 78 and 74. For example, the opening in the bypass orifice may be 0.018 inch in cross section, the passages 78 in the seat member may be 0.037 inch, and passage 74 in the seat member may be 0.050 inch With such a size relationship, any sediment or particles which will pass through the bypass orifice 28 will always be vented through the described passage system and to the outlet of the flush valve. No particles will be retained in chamber 30 or in any of the passages which might clog the venting channel for chamber 30. In this connection normally passage 52 will be substantially larger than the other described passages, for example, ⅛ inch.

Whereas the preferred form of the invention has been shown and described herein, it should be realized that there may be many modifications, substitutions and alterations thereto.

The embodiments of the invention in which an exclusive property are claimed are defined as follows:

1. A sensor-activated, battery-powered toilet room flush valve including a body having an inlet and an outlet, a valve seat between said inlet and outlet, a valve member in said body positioned to close upon said seat to control flow from said inlet to said outlet, a cover mounted on said body and defining a pressure chamber with said valve member, a sensor, solenoid and battery mounted on said cover and connected for operation of said flush valve, a passage in said cover connecting said pressure chamber and outlet, operation of said solenoid opening said passage to relieve pressure in said chamber through said passage to said outlet whereby said valve moves off its seat to open communication between said inlet and outlet, and a stop within said pressure chamber attached to said valve member limiting movement thereof toward said cover to control the volume of water through said flush valve prior to closure of said valve member on said valve seat.

2. The flush valve of claim 1 further characterized by and including means for adjusting the position of said stop relative to said cover.

3. The flush valve of claim 2 further characterized in that said stop is adjustable from the outlet side of said valve member and seat.

4. The flush valve of claim 2 further characterized by and including a piston disc attached to said valve member, an adjustable screw attached to said piston disc, and having said stop formed thereon.

5. The flush valve of claim 4 further characterized by and including a centrally located passage in said piston disc connecting said outlet with said cover passage.

6. The flush valve of claim 5 further characterized in that said stop is adjustable by movement of said adjustment screw from the end thereof facing said flush valve outlet.

7. The flush valve of claim 1 further characterized in that said valve member is a diaphragm.

8. The flush valve of claim 7 further characterized by and including a bypass orifice in said diaphragm connecting said inlet with said pressure chamber, said orifice having a cross section area smaller than that of said passage whereby any particle which will pass through said orifice will pass through said passage to said outlet.

9. The flush valve of claim 8 further characterized in that said cover includes a chamber seat member therein having a passage, said solenoid having a plunger which closes upon said seat member passage.

10. The flush valve of claim 9 further characterized in that said seat member has a plurality of openings, each of which has a cross sectional area larger than that of said orifice.

11. A toilet room flush valve including a body having an inlet and an outlet, a valve seat between said inlet and outlet, a diaphragm in said body positioned to close upon said seat to control flow from said inlet to said outlet, a cover mounted on said body and defining a pressure chamber with said diaphragm a bypass orifice in said diaphragm connecting said outlet and pressure chamber whereby the pressurization of said chamber maintains said diaphragm upon said seat, means responsive to activation of said flush valve, to vent said pressure chamber to said outlet whereby said diaphragm moves off said valve seat to open communication between said inlet and outlet, and a stop within said pressure chamber attached to said diaphragm limiting movement thereof toward said cover which controls the volume of water passing through said flush valve prior to closure of said diaphragm on said valve seat.

12. The flush valve of claim 11 further characterized in that said stop is adjustable.

13. The flush valve of claim 12 further characterized in that said stop is adjustable from the outlet side of said diaphragm.

14. The flush valve of claim 13 further characterized in that said stop is adjustable by a tool receiving opening therein facing the outlet of said flush valve.

15. The flush valve of claim 11 further characterized by and including a sensor, solenoid, and battery mounted on said cover and connected for activation of said flush valve, a passage in said cover connecting said pressure chamber and outlet, operation of said solenoid in response to the detection of an object by said sensor, opening said passage to relieve pressure in said chamber.

16. The flush valve of claim 15 further characterized in that said sensor includes an infrared transmitter and an infrared receiver.

17. The flush valve of claim 15 further characterized in that said cover passage includes a chamber in alignment with said solenoid, a seat positioned in said chamber, said solenoid having a plunger positioned to close upon said seat to close said cover passage.

18. The flush valve of claim 17 further characterized by and including a plurality of passages in said seat, the passages in said seat, each having a cross sectional area greater than that of the bypass orifice in said diaphragm.

19. The flush valve of claim 18 further characterized in that the cross sectional area of the smallest portion of said cover passage is greater than the cross sectional area of said bypass orifice whereby any particle that reaches said pressure chamber will be vented through said passage to said outlet.

* * * * *